US005307744A

United States Patent [19]

Newman et al.

[11] Patent Number: 5,307,744

[45] Date of Patent: May 3, 1994

[54] MAGNETIC SKIRT PRODUCT PROTECTION ASSEMBLY FOR TRANSPORTING ON RAILROAD CARS

[75] Inventors: Ronald R. Newman, Lenexa, Kans.; Roger D. Sims, Munster, Ind.

[73] Assignee: Burlington Northern Railroad Company, Fort Worth, Tex.

[21] Appl. No.: 946,746

[22] Filed: Sep. 17, 1992

[51] Int. Cl.[5] ..... B03B 1/00

[52] U.S. Cl. ..... 105/355; 105/238.1; 105/394; 105/463.1; 209/215

[58] Field of Search ..... 104/279, 307; 105/238.1, 350, 351, 352, 353, 463.1, 394, 355; 280/768, 769, 847, 848, 153.5, 154, 849, 854, 159, 160; 209/223.1, 215; 248/235, 240; 293/DIG. 1, DIG. 6, 102, 103

[56] References Cited

U.S. PATENT DOCUMENTS

| | | | |
|---|---|---|---|
| 604,867 | 5/1898 | Le Van | 105/352 |
| 1,114,997 | 10/1914 | Lieb | 248/235 |
| 1,224,016 | 4/1917 | Petersen | 248/235 |
| 1,726,158 | 8/1929 | Masury et al. . | |
| 1,745,970 | 2/1930 | Andrew . | |
| 2,605,119 | 7/1952 | Earnest | 280/160 |
| 2,629,495 | 2/1953 | Smale | 209/223 |
| 2,660,454 | 11/1953 | Coumerilh | 293/117 |
| 2,818,176 | 12/1957 | Polich | 209/215 |
| 3,698,680 | 10/1972 | Shoemaker | 248/235 |
| 3,956,111 | 5/1976 | Manfredi | 209/215 |
| 4,478,152 | 10/1984 | Holley | 104/279 |
| 4,541,661 | 9/1985 | Hawk | 293/117 |
| 4,903,856 | 2/1990 | Watts | 280/160 |

OTHER PUBLICATIONS

Ultra-Mag Flexible Magnetic Products-Strip and Custom Extrusions advertisement, FlexMag Industries, Inc., a DynaCast Company, Undated.

*Primary Examiner*—Mark T. Le

*Attorney, Agent, or Firm*—Merchant, Gould, Smith, Edell, Welter & Schmidt

[57] ABSTRACT

A magnetic skirt assembly is provided which is used as a metallic particle and grit collector on a railroad car to protect transported products. The magnetic skirt (20) includes a supporting frame structure (21) and a magnetic material (36) operatively attached thereto. The magnetic skirt is installed on the underside of the railroad car, preferably one skirt at each end of the railroad car adjacent to the outboard side of the wheel trucks. The magnetic skirts of the invention attract and collect fine metallic particles and grit on their magnetic surfaces which come off the railroad bed during transit of the railroad car. The design of the magnetic skirt particularly addresses the primary flow of air through the railroad car wheel trucks directed outboard and the airstream carrying the metallic particles flowing upward between rail cars which can potentially enter the gaps in the railroad car end doors. Periodically, the magnetic skirts can be cleaned or rinsed off to remove the accumulated grit or particles.

37 Claims, 4 Drawing Sheets

MAGNETIC SKIRT PRODUCT PROTECTION ASSEMBLY FOR TRANSPORTING ON RAILROAD CARS

FIELD OF THE INVENTION

The invention relates generally to a device for attracting and collecting metallic particles and grit in and around a railroad bed. More particularly, the invention relates to a magnetic skirt assembly for use on a railroad car which attracts and collects metallic particles and grit along the railroad bed during transit of the railroad car.

BACKGROUND OF THE INVENTION

The use of magnetic wheels to pick up metallic scrap along railroad beds is well known. When disassembling a rail for replacement, several small metallic articles including spikes, tie plates, and anchors are removed and laid upon the railroad bed. Since it is desirable to clear the railroad bed of such metallic articles and re-use such articles, various magnetic wheel constructions for picking up these metallic articles have been developed previously. For example, Holley, U.S. Pat. No. 4,478,152 discloses a railroad scrap pick-up machine having a magnetic wheel device that is useable with a rail-mounted vehicle for picking up scrap articles such as tie plates and rail spikes on the railroad bed.

New motor vehicles such as cars, light trucks, vans, etc., as well as a variety of other goods, are commonly transported on railroad cars from manufacturing plants to various destinations. Motor vehicles are usually transported in multi-level auto rack railroad freight cars. These multi-level rail cars usually have openings and gaps in their side wall screens and end doors which permit entrance of contaminants such as fine metallic grit or dust particles coming off the railroad bed during transit. Under the right conditions of temperature and humidity, these contaminants become airborne from the railroad bed, settle on the transported motor vehicles and then bloom into rust and damage the horizontal painted surfaces of the motor vehicles being transported. For example, iron filings are produced by rail grinder trains which are employed on railroads to grind the rail thereby extending rail life, however, leaving iron filings on the rail bed. When a train travels along the rail bed, these iron filings or other metallic particles are blown into the surrounding air and can enter the rail car via the end doors or side wall screens, causing rust damage on the transported motor vehicles, even after the vehicles have been deramped and set out on lots awaiting distribution. This problem has existed for many years and motor vehicle manufacturers who ship on the railroad lines want to prevent this problem. The increased activity of rail grinding by railroad companies has served to aggravate this problem.

Thus, minimizing the intrusion of contaminants such as metallic grit and dust particles into a rail car is important in order to prevent or reduce damage to motor vehicles and other goods being transported. The present invention helps to alleviate the above contamination problem as discussed in greater detail below.

SUMMARY OF THE INVENTION

The present invention is a magnetic skirt assembly for use on a railroad car for collecting metallic particles and grit from a railroad bed during transportation of the railroad car. The magnetic skirt comprises a supporting frame structure which can be attached to the underside of the railroad car, and a source of magnetic attraction operatively attached to the supporting frame structure. The magnetic source attracts and collects fine metallic particles and grit from the railroad bed which are blown into the surrounding air during travel of the railroad car thereby protecting transported products.

The magnetic skirt can further comprise a backing plate attached to the supporting frame structure, with the magnetic source attached to the backing plate. The magnetic skirt's supporting frame structure preferably comprises a plurality of L-shaped bracket members, a plurality of elongated brace members connected to the L-shaped bracket members, a plurality of vertical support members connected to the elongated brace members, and a plurality of U-shaped bracket members connected to the vertical support members. Preferably, the source of magnetic attraction, such as a permanent magnetic material is attached to the backing plate and the backing plate is attached to the frame structure with the same fastening means.

The present invention also relates to a magnetic device for use on a railroad car, which includes the combination of a railroad car having an underside, a plurality of wheel trucks attached to the underside of the railroad car, and at least one magnetic skirt assembly as described above attached to the underside of the railroad car adjacent to the the wheel trucks. Preferably, a magnetic skirt is installed, minimally, at each end of the railroad car near the outboard side of the wheel trucks. The railroad car is preferably a multi-level auto rack railroad freight car used for transporting motor vehicles. The magnetic skirt of the invention by capturing and holding the metallic particles helps to eliminate a source of contaminants by minimizing the intrusion of fine metallic dust particles and grit which come off of the railroad bed during transit of the rail car, thus helping to protect the horizontal painted surfaces of motor vehicles from rust damage.

The magnetic skirt will retain the collected metallic particles and grit for a few months until the particles can be physically removed through a cleaning process. The magnetic skirt has a minimum rail clearance, allows for wheel truck turning and servicing, does not interfere with the cushioning unit at the end of the rail car, has a washable surface, and is durable.

The present invention includes a method of attracting and collecting metallic particles and grit from a railroad bed during travel of a railroad car. The method comprises the steps of attaching a magnetic skirt assembly to an underside of a railroad car, the magnetic skirt comprising a supporting frame structure and a magnetic source attached thereto, and moving the railroad car along a railroad track. The magnetic skirt attracts and collects metallic particles and grit from the railroad bed during travel of the railroad car, substantially preventing the particles and grit from entering the railroad car.

One aspect of the invention is a novel, magnetic skirt assembly for a railroad car for collecting fine metallic particles and grit from a railroad bed. Another aspect of the invention is the combination of a railroad car and the magnetic skirt attached thereto. A further aspect of the invention is a method for attracting and collecting metallic particles and grit from a railroad bed to protect transported product from damage using the magnetic skirt of the invention.

BRIEF DESCRIPTION OF THE DRAWINGS

In the drawings, which form a part of the instant specification and are to be read therewith, a preferred embodiment of the invention is shown, and in the various views, like numerals are employed to indicate like parts.

DETAILED DESCRIPTION OF THE INVENTION

The invention is directed to a magnetic skirt assembly which is useable on a railroad car for attracting and collecting metallic particles and grit from a railroad bed during transit of the railroad car. The magnetic skirt is preferably used on multi-level auto rack railroad freight cars which transport new automobiles and other motor vehicles. Fine metallic particles or grit, such as iron filings, which come off the railroad bed during transit of the rail car can enter the rail car and cause rust damage on the horizontal painted surfaces of the transported motor vehicles. The magnetic skirt of the invention attracts and collects the metallic particles and periodically, the skirt can be cleaned or rinsed off to remove the accumulated particles. In utilizing the magnetic skirt on a rail car, the intrusion of metallic particles is minimized, helping to prevent such particles from damaging motor vehicles transported on the rail car.

The drawings depict various preferred embodiments of the invention which can be formed in a variety of ways. While the description will proceed with respect to such drawings, it will be readily understood by those skilled in the art that such description and drawings are used to explain the novel features of this invention, rather than in any limiting sense.

Figure 1:
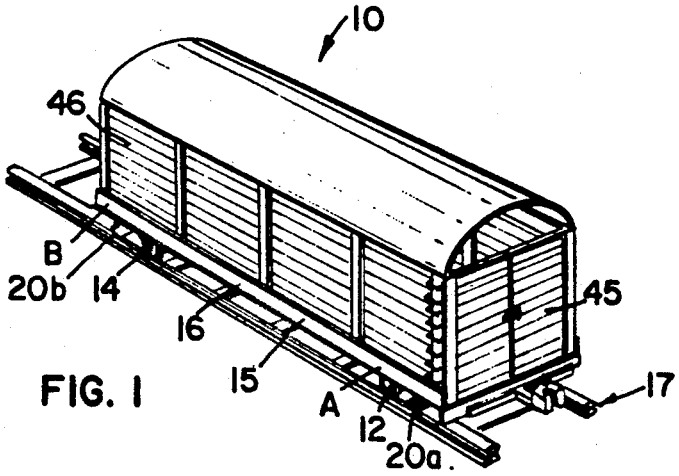
FIG. 1 is a perspective view of a rail car having attached at each end a magnetic skirt of the invention.

Referring to the drawings, FIG. 1 illustrates a conventional multi-level auto rack freight rail car 10 having a first end A and a second end B. Rail car 10 includes wheel trucks 12, 14 attached to the underside of deck 16 at each of opposing ends A and B, respectively. Side sill 15 is located on the lower side of rail car 10 adjacent to deck 16. Rail car 10 also includes end doors 45 and side wall screens 46. A magnetic skirt 20*a* is attached at end A of rail car 10 on the underside of deck 16 adjacent to wheel truck 12. Another magnetic skirt 20*b* is attached at opposite end B of rail car 10 adjacent to wheel truck 14 on the underside of deck 16. Preferably, the magnetic skirts 20*a*, 20*b* are disposed on rail car 10 in front of the wheel trucks 12, 14 as depicted in FIG. 1 toward each outboard end of rail car 10, so that the magnetic material 36 (discussed in greater detail below) faces the outboard ends of rail car 10.

Figure 2:
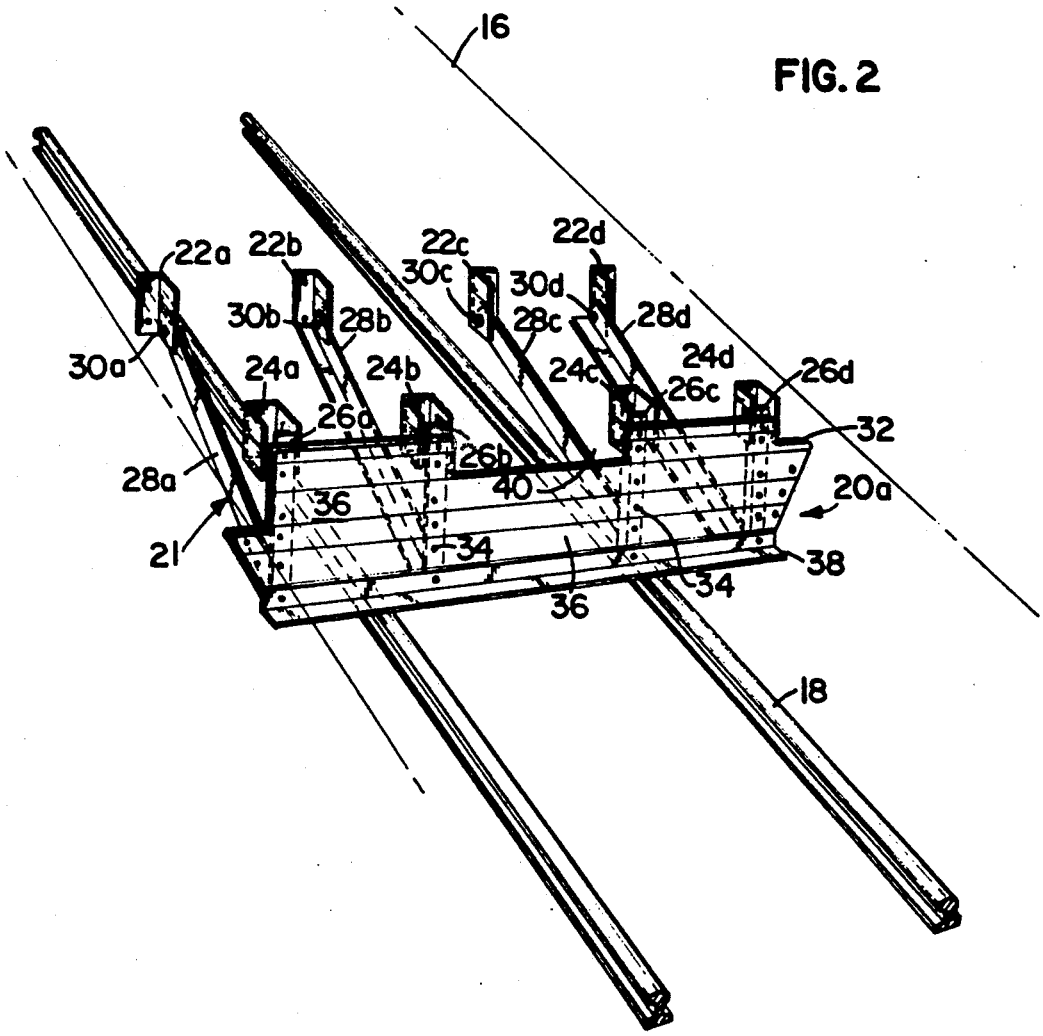
FIG. 2 is a perspective view of the magnetic skirt of the invention.
Figure 3:
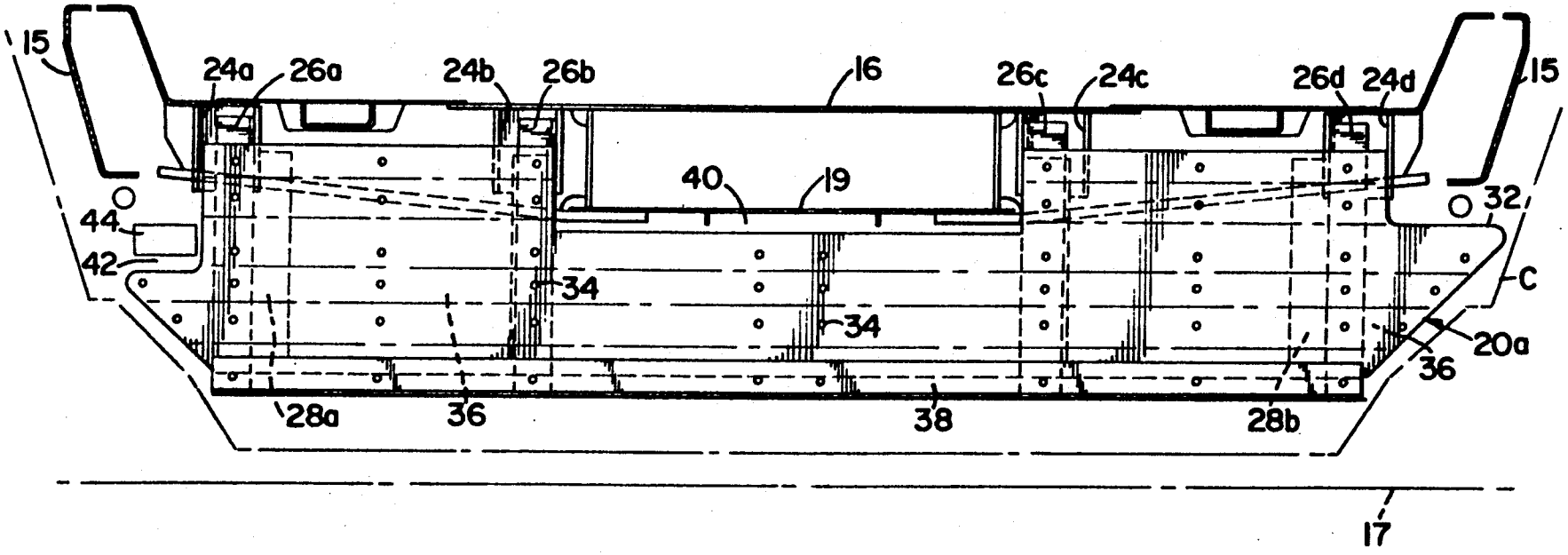
FIG. 3 is a front view of the magnetic skirt depicted in FIG. 2.

In FIG. 2, a close-up perspective view of magnetic skirt 20*a* is depicted and is shown attached to the underside of deck 16 (shown in phantom view). While the following description will proceed with respect to magnetic skirt 20*a*, it is to be understood that magnetic skirt 20*b* can be constructed in the same manner. Magnetic skirt 20*a* is attached to the underside of deck 16 so that magnetic skirt 20*a* clears rails 18 at a minimum height set by the railroads and other regulatory agencies (safety item) while rail car 10 is stationary or in transit. As seen in FIG. 3, a center sill lid 19 is located on the underside of deck 16 of rail car 10. A cut-out section 40 is provided in magnetic skirt 20*a* to allow for clearance of sill lid 19.

Figure 4:
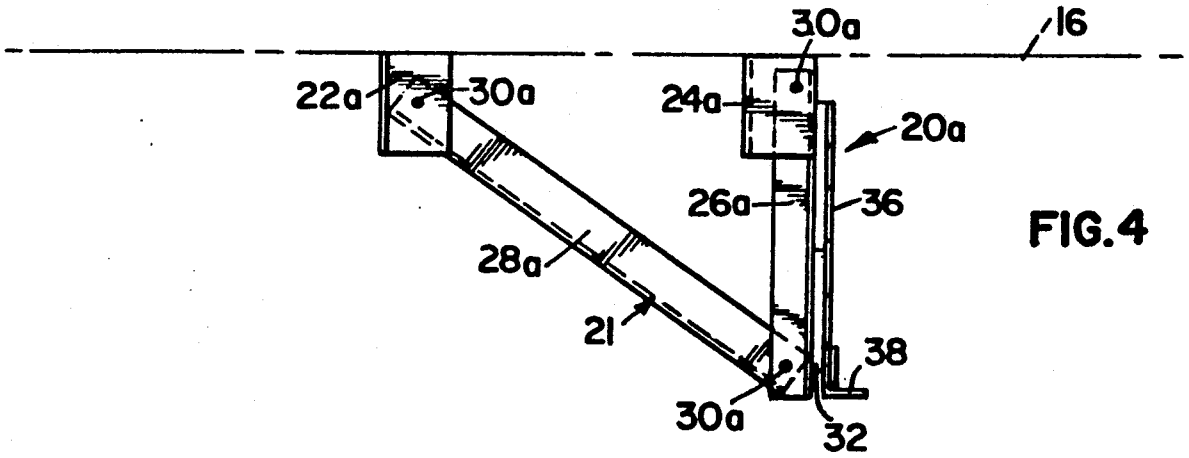
FIG. 4 is a side view of the magnetic skirt depicted in FIG. 2.

As shown in FIGS. 2–4, the magnetic skirt 20*a* includes a supporting frame structure 21 which includes L-shaped bracket members 22*a*, 22*b*, 22*c*, 22*d*, U-shaped bracket members 24*a*, 24*b*, 24*c*, 24*d*, vertical support brace members 26*a*, 26*b*, 26*c*, 26*d*, and elongated brace members 28*a*, 28*b*, 28*c*, 28*d*. Frame structure 21 is attached to the underside of deck 16 by any conventional fastening means, such as by welding. Preferably, L-shaped brackets 22*a*–22*d* and U-shaped bracket members 24*a*–24*d* are attached to the underside of deck 16 of rail car 10 by a first fastening means, such as by spot welding.

Elongated brace members 28*a*–28*d* having opposing first and second ends are connected at their first ends to L-shaped brackets 22*a*–22*d* with conventional connecting means 30*a*, 30*b*, 30*c*, 30*d* such as with bolts, nuts and washers. Vertical support members 26*a*–26*d* are connected to elongated brace members 28*a*–28*d* at their second ends, and U-shaped bracket members 24*a*–24*d* are connected to vertical support members 26*a*–26*d* at an opposite end from the brace member connections through a similar connecting means 30*a*. Preferably, the above bracket, brace, and support members are connected together to form the frame structure 21 by passing bolts with washers thereon through holes which have been made in the bracket, brace, and support members prior to assembly. Brace members 28*a*–28*d* are preferably attached to vertical support members 26*a*–26*d* and L-shaped bracket members 22*a*–22*d* so that brace members 28*a*–28*d* are disposed at about a 45° angle to deck 16.

A backing plate 32 can be optionally used in the invention and is attached to vertical support members 26*a*–26*d* with a second fastening means 34 such as bolts, nuts and washers. An elongated horizontal brace member 38 can be attached to backing plate 32 at a lower end thereof which is closest to rails 18 utilizing the second fastening means. Magnetic material 36 can be attached to backing plate 32 by any suitable attaching means. Preferably, corresponding holes are drilled in backing plate 32, brace member 38, vertical support members 26*a*–26*d*, and in magnetic material 36 so that the holes will align for insertion of the second fastening means. This facilitates the attachment of backing plate 32 to frame structure 21, and the attachment of magnetic material 36 and brace member 38 to backing plate 32. Thus, brace member 38 and magnetic material 36 can be attached to backing plate 32 at the same time as backing plate 32 is attached to vertical support members 26*a*–26*d* by using the same second fastening means.

As depicted in FIG. 3, the left side of magnetic skirt 20*a* has a cutout section 42 so that brake chain 44 will not be interfered with. A J-shaped guide (not shown) for the brake chain 44 can be added to keep the brake chain 44 off the magnetic material 36 of magnetic skirts 20*a*, 20*b*. The supporting frame structure 21 and the backing plate 32 are preferably made from iron or steel.

Figure 6:
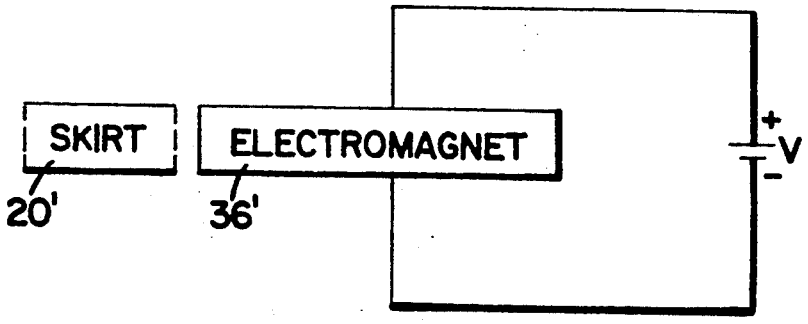
FIG. 6 is a functional block diagram of an alternative magnetic skirt of the invention, utilizing an electromagnet as a source of magnetic attraction.

The source of magnetic attraction utilized in the magnetic skirt of the invention can be made from a variety of materials. For example, the magnetic material 36 is preferably a permanent magnet such as a bonded flexible magnetic material or other equivalent which has a multiple pole magnet design. One suitable flexible magnetic material is Ultra-Mag which is produced by Dynacast, and is available in a magnetic sheet, strip or extrusion material. The magnetic source utilized in the invention can also be an electro-magnet. FIG. 6 shows an alternative embodiment magnetic skirt 20', where an electro-magnet 36' is used in lieu of magnetic material 36. For example, an axle generator could be used to power wires wrapped around steel bars to create a magnetic surface which can be attached to the supporting frame structure of the invention.

The present invention also goes to a method of attracting and collecting metallic particles and grit from a railroad bed during travel of a railroad car by using the magnetic skirt of the invention. The method comprises the steps of attaching at least one magnetic skirt, comprising a supporting frame structure having a magnetic source operatively attached to the frame structure, to an underside of a railroad car, and moving the railroad car along a railroad track. The magnetic skirt attracts and collects metallic particles and grit from the railroad bed during travel of the railroad car, substantially preventing the particles and grit from entering the railroad car.

Preferably, the railroad car has at least two magnetic skirts attached thereto at opposing ends thereof as depicted in FIG. 1, with the magnetic skirts disposed toward each outboard end of the railroad car. The railroad car is preferably a multi-level freight car for transporting motor vehicles, although other types of rail cars can also use the magnetic skirt of the invention. The magnetic skirt attracts and collects metallic contaminants, including iron filings located in and around a railroad bed as well as other metallic particles and grit which can damage the painted surfaces of motor vehicles in transit on the railroad car. The magnetic field generated by the magnetic skirt picks up only airborne iron filings and other metallic particles. A separate vehicle such as disclosed in Holley, U.S. Pat. No. 4,478,152 is used to pick up metallic scraps such as tie plates and rail spikes.

While not wishing to be bound by any theory, we believe that the magnetic skirt of the invention attracts and collects metallic particles from a railroad bed by particularly taking advantage of primary airflow from the railroad bed which passes through the railroad car wheel trucks. The airstream flows upward between rail cars and can potentially enter the end doors of the rail car. Since the airflow is altered by the presence of the skirt, the contamination problem is avoided through improved airflow. For example, the "chimney effect", in which an updraft flow of air is created between rail cars, may be favorably altered by use of the magnetic skirt, thus reducing contaminants that enter gaps in the upper levels of the rail car, such as the vertical crack in the end doors and other gaps.

While the drawings show the magnetic skirt mounted orthogonally to the rail car underside, it is to be understood that the skirt can be mounted at a variety of angles to the underside, preferably from about a 90° angle to about a 45° angle to the underside of the rail car. Varying the angle of attachment can increase the total exposed magnetic surface as well as favorably influence the aerodynamics. Altering the orthogonal relationship with the rail car longitudinal center line can also be beneficial. Furthermore, different contours for the skirt's perimeter can also favorably influence the air flow and particle attraction and retention. Holes can also be added in the skirt for enhanced aerodynamics and retention of particles.

The magnetic skirt of the invention attracts and collects metallic particles and grit while a train travels at various speeds, preferably up to 70 miles per hour. The magnetic skirt will retain the collected particles for a few months until the particles can be physically removed through a cleaning or rinsing process. The magnetic skirt provides for a minimum rail clearance, and has the advantages of allowing wheel truck turning and servicing, noninterference with the cushioning unit at the end of the rail car, a washable surface, and durability.

ASSEMBLY OF PREFERRED EMBODIMENT

The following procedure, materials and equipment were used in constructing a magnetic skirt and attaching it to a multi-level (tri-level) auto rack railroad car according to the present invention. In referring to the rail car, A and B ends of the rail car are defined as seen in FIG. 1. Two magnetic skirts **20*a*, 20*b*, one for each outboard end of the rail car, were assembled and attached to the rail car as shown in FIG. 1**. The relevant parts of the rail car that were taken into consideration in attaching the magnetic skirts were the brake lines, crossbearers, center sill web, and the underside of the deck.

In constructing the magnetic skirts of the invention, several pieces of equipment were used in assembling the magnetic skirt to the rail car including a torch, drill press, radial arm saw, impact wrenches, grinders, welder, chain saw with a special blade to cut steel, forklift, stencil machine, jacks and portable generator. A supporting frame structure 21 was constructed using 3 by 3 inch angle irons and 5 by 5 inch L-shaped and U-shaped brackets. A 3/16 inch backing plate 32 was used to mount the magnetic material 36 and to enhance their magnetic field attraction. This construction utilized ½" bolts and locking nuts with washers on each side for attaching the magnets to the backing plate and the backing plate to the supporting frame. In attaching the magnetic skirt to the underside of the rail car, the 5 by 5 inch L- and U-shaped brackets (**22*a*–22*d*, 24*a*–24*d*) were welded to the bottom of the deck for hanging of the skirt. The angle irons were cut to the appropriate lengths to form vertical support members (26*a*–26*d*) and elongated brace members (28*a*–28*d***), and holes were drilled and burned in the angle irons and backing plate for the bolts prior to assembly. The 3/16 inch backing plate and magnets were also cut out for the skirts prior to assembly.

In a first method of attachment used on magnetic skirt **20*a*, the supporting frame was assembled and attached to the rail car without the backing plate or the magnets. The frame was positioned 8 ½ inches inboard from the last crossbearer of the A-end of the rail car. The 5 by 5 inch brackets were then tack welded to the bottom of the deck. While the brackets were being welded to the bottom of the deck, the backing plate and magnets were assembled. The assembled backing plate and magnets were then slid under the rail car and mounted to the frame. In a second method of attachment used on magnetic skirt 20*b***, the magnetic skirt was assembled first minus the 5 by 5 inch brackets, and larger holes were cut in the supporting frame to allow for adjustment during installation of the magnetic skirt. The 5 by 5 inch brackets were welded to the underside of the rail car deck and the assembled skirt was then jacked up and connected to the brackets. A "J" shaped guide for the brake chain was added to keep the brake chain off of the magnets of both magnetic skirts.

A stencil stating the magnetic skirt cleaning requirements was applied on the side sill 15 at all four corners of the rail car. A black background was painted full height on the side sill with white letters used on the black background near the skirt location stating the cleaning requirements. Once assembled, all surfaces of the magnetic skirt were sanded and cleaned with soap and water. When all the skirt surfaces were dry, two coats of primer were applied and the primer was allowed to dry thoroughly overnight. Two coats of white paint were applied the next day. The materials used to complete the painting of the skirts were 80 grit sandpaper, sanding block, paint brush and 4" roller, Pratt & Lambert Exterior Gloss white paint, Pratt & Lambert primer, soap and water.

Calculations were made to achieve the required vertical track clearance for the magnetic skirts. (See Table I below). The entire magnetic skirt was designed to be within the plate C clearance diagram (See FIG. 3). (AAR Specification, Section C; AAR Specification M-1001, Section 2.1.4.3.).

TABLE I

| Vertical Clearance Requirement | |
|---|---|
| Maximum wear | 2" |
| 75% of spring travel (.75 × 3 11/16) | 2¾" |
| Vertical curve (1250 ft.) | 2⅝" |
| Car body deflection | 0 |
| Total required clearance | 7¾" |

Since the multi-level rail car had some wear and spring travel existing, the above rail clearance was established from a theoretical distance from the underside of the deck. A rough check of this clearance was made at the location where the skirt was installed and an 8 inch measurement was noted.

TESTING OF MAGNETIC MATERIALS

Several types of tests were utilized to quantify the actual magnetic field strength of the magnets used on the magnetic skirt of the invention. The magnetic field strength of the magnets was electronically measured using a Gauss meter in both laboratory samples and on the finished mounted magnetic skirt. The second type of testing employed was a pull test using an ounce scale which was used to quantify physical magnetic attraction. This test was also performed in the laboratory and on a finished skirt. The effectiveness of the magnets were also measured through a drop test using fine iron metal filings in the laboratory. This test involved the dropping of metal filings in front of the magnets at certain distances to measure the amount of metal filings the magnets would pick up.

I. Laboratory Testing

The following tests were run on a scaled down sample of the magnetic skirt of the invention. The sample skirt was made with the same magnetic material used in the invention. The results of these tests are discussed below.

A. Gauss Meter

Readings of the magnets on the sample skirt were taken with a Gauss meter in three areas, the top, the middle between two magnets, and the bottom. The readings varied from −141 to −231 on the negative side and from +192 to +215 on the positive side.

B. Pull Test

Pull tests were run on the scaled down sample skirt using an ounce scale. To perform this test, a metal washer was placed in between a flathead bolt and tightened by a nut. A string was tied to the threads of the bolt and connected to a metal bracket that slipped over the scale. The washer was then stuck to the magnets. With the scale parallel to the magnets, the scale was pulled perpendicular to the magnets upwards until the washer broke free. The measurements varied from 3 to 10 ounces.

A test similar to the test with the scale was performed, but without the scale. The sample skirt was tilted 45° and a washer/bolt with string was used. The string was tied to the threads of the bolt and hung perpendicular to the magnet and the floor. Paper clips were clipped to the string until the washer broke loose from the magnet. The largest variation in this pull test came from the location on the magnet. On a single magnet, several places were tested and a variation of 20 paper clips or 0.4 ounces was identified.

C. Drop Test

Drop Tests were run on the scaled down sample skirt using fine iron metal filings to test the effectiveness of the magnets at certain distances in picking up the metal filings. The metal filings were placed on a piece of cardboard and held over the top of the magnets. Then, gently tapping the cardboard and tilting it, the metal filings were sprinkled down the side of the sample. The cardboard was placed at ¼ inch, ½ inch, and ¾ inch away from the magnets to measure the quantity of fine metal filings caught by the magnets. Table II shows that as the distance from the face of the sample skirt increased, the percent weight of the metal filings collected by the sample magnets decreased.

TABLE II

| DROP TEST | |
|---|---|
| DISTANCE FROM SAMPLE FACE | % WEIGHT ON MAGNET |
| ¼ inch | 77% |
| ½ inch | 53% |
| ¾ inch | 14% |

II. Testing of Finished Skirts

Figure 5:
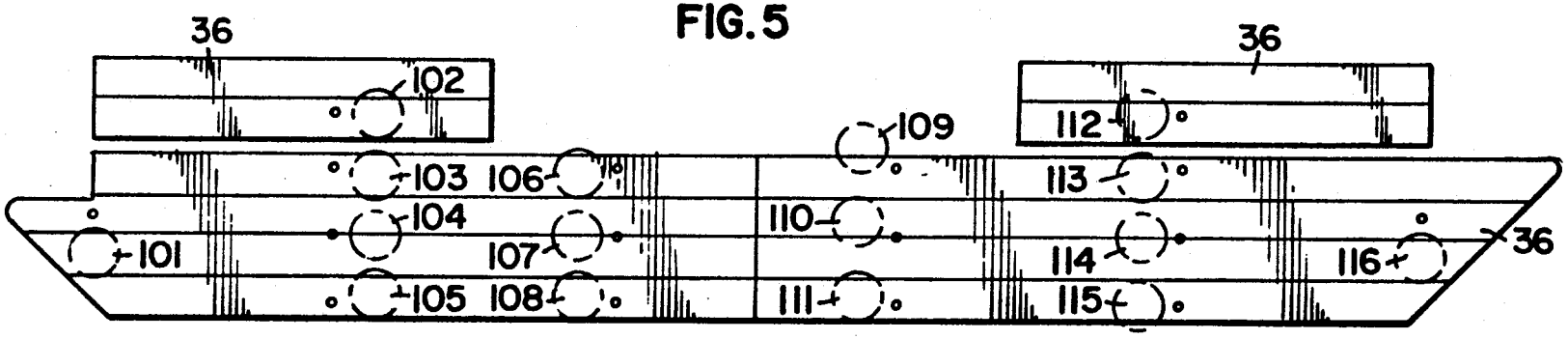
FIG. 5 is a front view of the magnetic materials utilized on the magnetic skirt depicted in FIG. 2.

Tests were also performed on the finished magnetic skirts attached to a rail car as depicted in FIG. 1. Both of the magnetic skirts on the A and B ends of the rail car were tested. The magnetic skirts were tested by taking magnetic readings across a grid on both sides of each magnet with a Gauss meter. The readings were taken on both the inboard and outboard sides of the skirts at the A and B ends of the rail car at various locations. The test locations (101–116) for the magnetic skirts are shown in FIG. 5 which depicts the layout of the magnetic material 36. The readings, read from the negative side and positive side of the magnets, varied from −129 to −403 on the negative side and +140 to +324 on the positive side. On locations 104, 107 and 114 (See FIG. 5) the readings were taken from the bottom of one magnet to the top of another magnet. Table III summarizes the results of the Gauss reading measurements taken at locations 101 to 116 (See FIG. 5) on the magnetic material 36 for both the A end and B end magnetic skirts.

The pull test was also performed on the finished magnetic skirt. An ounce scale was used by tilting it 45° and pulling perpendicular to the magnets. These pull tests were taken at locations 113, 114, 115, and 116 on the A end skirt, inboard side. The results of the pull test are summarized in Table III below.

TABLE III

MAGNETIC MEASUREMENTS WITH GAUSS METER AND PULL TEST

| Location | Pull Test (ounces) | Gauss Reading Measurements A Inboard | A Outboard | B Inboard | B Outboard |
|---|---|---|---|---|---|
| 101 | — | −291 | 142 | −192 | −155 |
| | | 303 | −165 | −245 | 140 |
| 102 | — | 221 | −258 | 223 | −149 |
| | | −294 | 275 | −186 | 159 |
| 103 | — | 271 | 238 | 179 | −247 |
| | | −292 | −231 | −129 | 162 |
| 104* | — | −294 | 324 | 146 | −200 |
| | | −238 | 224 | −272 | 254 |
| 105 | | 265 | −171 | 175 | −173 |
| | | −279 | 202 | 155 | 222 |
| 106 | — | 283 | −261 | 206 | −277 |
| | | −267 | 233 | −177 | 188 |
| 107* | — | −320 | 283 | 125 | −153 |
| | | −267 | 254 | −258 | 231 |
| 108 | — | 314 | −140 | 262 | 219 |
| | | −315 | 251 | −230 | −183 |
| 109 | — | 233 | 235 | −204 | 160 |
| | | −251 | −323 | 196 | −173 |
| 110 | — | 263 | −403 | 262 | −356 |
| | | 213 | −243 | 242 | −205 |
| 111 | — | 261 | −201 | 272 | −163 |
| | | −283 | 196 | −267 | 156 |
| 112 | — | −221 | 203 | 215 | 168 |
| | | 237 | −169 | −173 | −154 |
| 113 | 10** | −263 | 254 | −154 | 143 |
| | | 273 | −205 | 139 | −137 |
| 114* | 9** | 271 | −333 | 241 | −286 |
| | | 233 | −253 | 236 | −257 |
| 115 | 8** | 263 | −304 | 291 | −215 |
| | | −222 | 227 | −218 | 147 |
| 116 | 8** | −220 | −170 | 168 | 246 |
| | | 189 | 150 | −242 | 269 |

*Two magnets edge to edge.
**Pull Test in ounces at these locations (A End Inboard).

Even though numerous characteristics and advantages of the invention have been set forth in the foregoing description, together with details of the structure and function of the invention, the disclosure is illustrative only and changes may be made in detail, especially in matters of shape, size, and arrangement of parts, within the principles of the invention, to the full extent indicated by the broad general meaning of the appended claims.

What is claimed is:

1. A magnetic skirt assembly for use on a railroad car for collecting airborne metallic particles from a railroad bed, comprising:

(a) a supporting frame structure arranged and configured to be attached to an underside of a railroad car; and (b) magnetic means, operatively connected to said supporting frame structure, for attracting and collecting airborne metallic particles from a railroad bed, said magnetic means being oriented on said supporting frame structure to attract the airborne metallic particles, wherein during travel of the railroad car on the railroad bed, said magnetic means attracts and collects metallic particles from the railroad bed which have become airborne, thereby protecting products transported on the railroad car from the airborne metallic particles.

2. The magnetic skirt assembly of claim 1 further comprising a backing plate attached to said supporting frame structure, wherein said magnetic means is attached to said backing plate.

3. The magnetic skirt assembly of claim 1, wherein said supporting frame structure comprises:

(a) a plurality of vertical support members, each of said vertical support members having a first and a second end and being arranged and configured to extend generally orthogonal to the underside of a railroad car, wherein each of said vertical support members is connectable proximate said first end to the underside of the railroad car by a U-shaped bracket member; and (b) a plurality of elongated brace members, each of said elongated brace members having a first and a second end, said second end being operatively connected to the second end of one of said plurality of vertical support members, and said first end being arranged and configured to be connectable to the underside of the railroad car by an L-shaped bracket member.

4. The magnetic skirt assembly of claim 3, wherein said elongated brace members are spatially oriented to form about a 45 degree angle with the underside of the railroad car when said magnetic skirt assembly is attached thereto.

5. The magnetic skirt assembly of claim 2, wherein said supporting frame structure and said backing plate are made from iron or steel.

6. The magnetic skirt assembly of claim 1, wherein said magnetic means is a permanent magnetic material or an electro-magnet.

7. The magnetic skirt assembly of claim 2, wherein said magnetic means is attached to said backing plate and said backing plate is attached to said frame structure with the same fastening means.

8. A magnetic device for use on a railroad car, the combination comprising:

(a) a railroad car having an underside;

(b) a plurality of wheel trucks attached to said underside of said railroad car; and (c) at least one magnetic skirt assembly, operatively connected to said underside of said railroad car proximate said wheel trucks, said magnetic skirt assembly including magnetic means for attracting and collecting airborne metallic particles from a railroad bed, said magnetic means being oriented to attract the airborne metallic particles, wherein during travel of said railroad car on the railroad bed, said magnetic means attracts and collects metallic particles from the railroad bed which have become airborne, thereby protecting products transported on said railroad car from the airborne metallic particles.

9. The magnetic device combination of claim 8, wherein said magnetic skirt assembly further includes a supporting frame structure for operatively connecting said magnetic means to said underside of said railroad car, said supporting frame structure including:

(a) a plurality of vertical support members, each of said vertical support members having a first and a second end and being arranged and configured to extend generally orthogonal to said underside of said railroad car, wherein each of said vertical support members is operatively connected proximate said first end to said underside of said railroad car by a U-shaped bracket member; and (b) a plurality of elongated brace members, each of said elongated brace members having a first and a second end, said second end being operatively connected to said second end of one of said plurality of vertical support members, and said first end being operatively connected to said underside of said railroad car by an L-shaped bracket member.

10. The magnetic device combination of claim 9, wherein said elongated brace members are positioned to form about a 45 degree angle with said underside of said railroad car.

11. The magnetic device combination of claim 9, wherein said magnetic skirt assembly further comprises a backing plate attached to said supporting frame structure, wherein said magnetic means is attached to said backing plate, and wherein said supporting frame structure and said backing plate are made from iron or steel.

12. The magnetic device combination of claim 9, wherein said magnetic skirt assembly further comprises first fastening means for securing said supporting frame structure to said underside of said railroad car.

13. The magnetic device combination of claim 12, wherein said magnetic skirt assembly further comprises second fastening means for securing said magnetic means to said backing plate and said backing plate to said frame structure.

14. The magnetic device combination of claim 13, wherein said magnetic means is a permanent flexible magnetic material.

15. The magnetic device combination of claim 14, wherein said magnetic means is bolted to said backing plate and said backing plate is bolted to said frame structure.

16. The magnetic device combination of claim 8, wherein said magnetic means is oriented to face an outboard end of said railroad car.

17. The magnetic device combination of claim 8, wherein said railroad car has two magnetic skirt assemblies attached thereto at opposing ends thereof, each of said magnetic skirt assemblies disposed between one of said wheel trucks and one outboard end of said railroad car.

18. The magnetic device combination of claim 8, wherein said railroad car is a multi-level freight car for transporting motor vehicles.

19. A method of attracting and collecting airborne metallic particles from a railroad bed during travel of a railroad car, said method comprising the steps of:

(a) attaching at least one magnetic skirt assembly to an underside of a railroad car, said magnetic skirt assembly comprising:

(i) a supporting frame structure operatively connected to the underside of the railroad car; and (ii) magnetic means, operatively connected to said supporting frame structure, for attracting and collecting airborne metallic particles from a railroad bed, said magnetic means being oriented on said supporting frame structure to attract the airborne metallic particles; and (b) moving the railroad car along a railroad track disposed on a railroad bed; wherein during movement of the railroad car on the railroad track, said magnetic means attracts and collects metallic particles from the railroad bed which have become airborne, thereby protecting products transported on the railroad car from the airborne metallic particles.

20. The method of claim 19, wherein said magnetic skirt assembly further comprises a backing plate attached to said supporting frame structure, and wherein said magnetic means is attached to said backing plate.

21. The method of claim 19, wherein said supporting frame structure comprises:

(a) a plurality of vertical support members, each of said vertical support members having a first and a second end and being arranged and configured to extend generally orthogonal to the underside of the railroad car, wherein each of said vertical support members is operatively connected proximate said first end to the underside of the railroad car by a U-shaped bracket member; and (b) a plurality of elongated brace members, each of said elongated brace members having a first and a second end, said second end being operatively connected to said second end of one of said plurality of vertical support members, and said first end being operatively connected to the underside of the railroad car by an L-shaped bracket member.

22. The method of claim 21, wherein said elongated brace members are positioned to form about a 45 degree angle with the underside of the railroad car.

23. The method of claim 20, wherein said supporting frame structure and said backing plate are made from iron or steel.

24. The method of claim 20, further comprising first fastening means for securing said supporting frame structure to the underside of the railroad car.

25. The method of claim 24, further comprising second fastening means for securing said backing plate to said supporting frame structure and said magnetic means to said backing plate.

26. The method of claim 19, wherein said magnetic means is a permanent magnetic material.

27. The method of claim 20, wherein said magnetic means is bolted to said backing plate and said backing plate is bolted to said supporting frame structure.

28. The method of claim 19, wherein said magnetic means faces an outboard end of the railroad car.

29. The method of claim 29, further comprising the step of attaching two magnetic skirt assemblies to the railroad car at opposing ends thereof, said magnetic skirt assemblies being disposed toward each outboard end of the railroad car.

30. The method of claim 19, wherein the railroad car is a multi-level freight car for transporting motor vehicles.

31. A method for protecting products transported on a railroad car, which is one of a train of cars moving on tracks over a railroad bed, from airborne metallic particles, the method comprising the steps of:

(a) attaching a magnetic source on an underside of the railroad car;

(b) attracting airborne metallic particles with the magnetic source during transportation of the products on the railroad car as it moves over the railroad bed, wherein said magnetic source attracts and collects airborne metallic particles dispersed from the railroad bed due to air currents generated by movement of the train.

32. The method of claim 31, further comprising the steps of:

(a) attaching the magnetic source on the underside of the railroad car proximate a wheel truck; and (b) orienting the magnetic source such that airflow around the wheel truck during movement of the railroad car is improved, thereby reducing updraft between the railroad car and a railroad car in the train.

33. A magnetic skirt assembly for use on a railroad car for collecting airborne metallic particles from a railroad bed, comprising:

(a) a supporting frame structure arranged and configured for rigid attachment to an underside of a railroad car proximate a wheel truck; and (b) magnetic means, operatively connected to said supporting frame structure, for attracting and collecting airborne metallic particles, said magnetic means being oriented on said supporting frame structure to attract the airborne metallic particles and to improve airflow around the wheel truck; wherein during travel of the railroad car on the railroad bed, said magnetic means attracts and collects metallic particles from the railroad bed which have become airborne, and reduces updraft between the railroad car and an adjacent railroad car, thereby protecting products transported on the railroad car from the airborne metallic particles.

34. A magnetic skirt assembly for use on a railroad car for collecting airborne metallic particles from a railroad bed, comprising:

(a) a supporting frame structure arranged and configured to be attached to an underside of a railroad car, said supporting frame structure including:

(i) a plurality of vertical support members, each of said vertical support members having a first and a second end and being arranged and configured to extend generally orthogonal to the underside of a railroad car, wherein each of said vertical support members is connectable proximate said first end to the underside of the railroad car; and (ii) a plurality of elongated brace members, each of said elongated brace members having a first and a second end, said second end being operatively connected to the second end of one of said plurality of vertical support members, and said first end being arranged and configured to be connectable to the underside of the railroad car; and (b) magnetic means, operatively connected to said supporting frame structure, for attracting and collecting airborne metallic particles from a railroad bed, said magnetic means being oriented on said supporting frame structure to attract the airborne metallic particles, whereby during travel of the railroad car on the railroad bed, said magnetic means attracts and collects the metallic particles from the railroad bed which have become airborne, thereby protecting products transported on the railroad car from the airborne metallic particles.

35. The magnetic skirt assembly of claim 34, wherein said plurality of vertical support members are attached to the underside of the railroad car by U-shaped bracket members and said plurality of elongated brace members are attached to the underside of the railroad car by an L-shaped bracket member.

36. The magnetic skirt assembly of claim 34, wherein said elongated brace members are spatially oriented to form about a 45 degree angle with the underside of the railroad car when said magnetic skirt assembly is attached thereto.

37. The magnetic skirt assembly of claim 35, wherein said elongated brace members are spatially oriented to form about a 45 degree angel with the underside of the railroad car when said magnetic skirt assembly is attached thereto.

* * * * *

UNITED STATES PATENT AND TRADEMARK OFFICE

CERTIFICATE OF CORRECTION

PATENT NO. : 5,307,744

DATED : May 3, 1994

INVENTOR(S) : RONALD R. NEWMAN et al.

It is certified that error appears in the above-identified patent and that said Letters Patent is hereby corrected as shown below:

In Column 12, line 50, for "29" read --19--.

Signed and Sealed this

Twentieth Day of September, 1994

*Attest:*

*Attesting Officer*

BRUCE LEHMAN

*Commissioner of Patents and Trademarks*